US006232033B1

(12) United States Patent
Cameron

(10) Patent No.: US 6,232,033 B1
(45) **Date of Patent: *May 15, 2001**

(54) METHOD FOR MAKING PAPER EMULSION CINEMATIC FILM

(76) Inventor: Donna Cameron, 743 President St., Brooklyn, NY (US) 11215

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 07/713,529

(22) Filed: Jun. 12, 1991

(51) Int. Cl.[7] ..... G03C 5/12; G03C 11/12; G03C 11/14

(52) U.S. Cl. ..... 430/256; 430/9; 430/11; 430/13; 430/403; 430/432; 430/496; 430/538; 430/934; 156/249; 156/344; 352/45; 352/97; 352/130; 352/237; 352/239; 428/203; 428/211

(58) Field of Search ..... 430/9, 11, 13, 430/256, 403, 501, 934, 538, 496, 432, 939; 156/60, 272.2, 249, 344; 428/203, 211, 195; 352/45, 97, 130, 237, 239

(56) References Cited

U.S. PATENT DOCUMENTS 4,216,286 * 8/1980 Greene et al. ..... 430/256

FOREIGN PATENT DOCUMENTS 1-188400 * 7/1989 (JP) ..... 156/249

* cited by examiner

*Primary Examiner*—Richard L. Schilling
(74) *Attorney, Agent, or Firm*—George A. Herbste; Pearson & Pearson

(57) ABSTRACT

A paper emulsion film product and method for producing the same is shown. The film product includes a first layer of editing tape, a second layer of editing tape, and a layer of paper emulsion formed from a paper reproduction of a photograph sandwiched between the respective layers of editing tape.

2 Claims, 1 Drawing Sheet

METHOD FOR MAKING PAPER EMULSION CINEMATIC FILM

BACKGROUND OF THE INVENTION

The present invention generally relates to motion pictures and processes for making motion pictures. More specifically, the present invention relates to a novel cinematic technique for production in the film printing office and to the film products resulting from the use of this technique.

As understood by those skilled in the art a motion picture is a series of pictures or images projected in rapid succession to produce the optical effect of a continuously-moving picture. These images are captured by a light-sensitive chemical emulsion disposed on a thin strip of cellulose acetate or cellulose nitrate. The chemical emulsions utilized in the prior art generally comprise a sensitive silver salt or a mixture of silver halides in a viscous medium (as a gelatin solution). In U.S. Pat. No. 1,649,756 to Thornton a process for manufacture of a film positive is disclosed generally comprising applying a cement on a printed colloid-face, applying the cement in exceedingly tenuous layers, drying the layers of cement separately, softening the layers and applying pressure. This process was provided to correct the "ground-glass" effect in milled film-print.

Laminated film is known in the prior art to be useful for preventing the destruction of film print during various operations. In U.S. Pat. No. 987,092 to Thompson a moving picture film is disclosed wherein a photographic picture film is interposed between a flexible transparent carrying web and a scratch-resistant coating. U.S. Pat. No. 1,649,756 and U.S. Pat. No. 1,670,672 respectively to Thornton disclose a cinematic film of the scratchless-enclosed-image type where two printed colloid films are cemented face-to-face by a liquid cement to form a unitary moving picture film. A transparent protective coating on a motion picture film is shown in U.S. Pat. No. 2,608,127 to Redfield. Protected photographic films are also shown in the prior art. A photographic film having a coating of cellulose acetate phthalate is disclosed in U.S. Pat. No. 2,259,009 to Talbot. U.S. Pat. No. 2,331,746, also to Talbot, discloses a photographic film coated with a cellulose ether containing a dicarboxylic acid radical. U.S. Pat. No. 2,578,282 to Bliss discloses a photographic film including an emulsion layer laminated with a transparent protective sheet comprising a cellulose ester sheet having a gelatin layer on one side secured to the emulsion layer and a cellulose ester layer containing a finely-divided pigment on the opposite side. Coated photographic films are also shown in U.S. Pat. No. 3,079,837 to Theilemann, U.S. Pat. No. 4,558,002 to Aotsuka et al., and U.S. Pat. No. 4,705,746 to Tamagawa et al.

Prior art processes for making cinematic and photographic films have generally focused on adhering a light-sensitive chemical emulsion to a film support. Exemplary processes are shown in U.S. Pat. No. 2,168,051 to Smith et al. and U.S. Pat. No. 4,814,132 to Aoki et al. Processes for producing a laminated cinematic film are disclosed in U.S. Pat. Nos. 1,649,756 and 1,670,672 respectively to Thornton.

A light-sensitive photographic chemical emulsion disposed on a muslin or similar fabric is disclosed in U.S. Pat. No. 559,658 to Anthony, and a photographically-sensitized tissue paper is shown in U.S. Pat. No. 1,219,739 to Jacobson.

The motion pictures of the prior art utilizing a chemical emulsion or a printed colloid-face produce a "standard" visual perception generally directed to recreating the visual perception experienced when viewing an object directly.

Various special effects techniques and computer-enhanced imaging are utilized to create alternative visual perceptions. However, the "touching of the eye" resulting from viewing the cinematic film of the present invention has not been known in the prior art before this invention.

SUMMARY OF THE INVENTION

The present invention is a process for production of a motion picture; a process for a film product; and articles of manufacture. From a printed photograph a paper reproduction (color or b/w) is made on at least two-ply paper. The paper reproduction is framed according to the artist's desires and clean, perforated editing tape, one side sticky, is applied sticky side to the face of the paper reproduction. The face of the combined editing tape and framed paper reproduction is rubbed while laying on a hard surface. The paper reproduction is cut along the side edges of the editing tape to form film-size strips. The tape film strip is then soaked in a lukewarm bath until the editing tape and the rear ply of the paper reproduction separate. The tape film strip is then soaked in a clean lukewarm bath and the paper reproduction is rubbed to remove paper in excess of the image layer. The tape film strip is then let to dry. Transparent editing tape is then applied sticky side to the rear of the image layer aligning the sprocket holes of the tape film strip and the editing tape. The laminated tape film strip is then utilized to print a projectable film product.

The projectable film product of the present invention provides a unique optical effect when projected on a screen. A "textured" quality is added to the images in the paper reproduction. The visual perception appears to be impacted in a manner creating an illusion of the eye being touched without distortion.

An object of the present invention is to provide a new and useful paper emulsion sculpture.

It is also an object of this invention to provide a novel film print product.

Another object of the present invention is to provide a novel motion picture.

A further object of this invention is to provide a process for producing a novel film product and a process for producing a motion picture.

A still further object of the present invention is to provide a process of film production which gives virtually unlimited creative flexibility to an artist.

These and other objects and advantages of the present invention will be apparent to those skilled in the art from the following description of preferred products and methods of production and appended claims.

DESCRIPTION OF PREFERRED EMBODIMENTS

Figure 1:
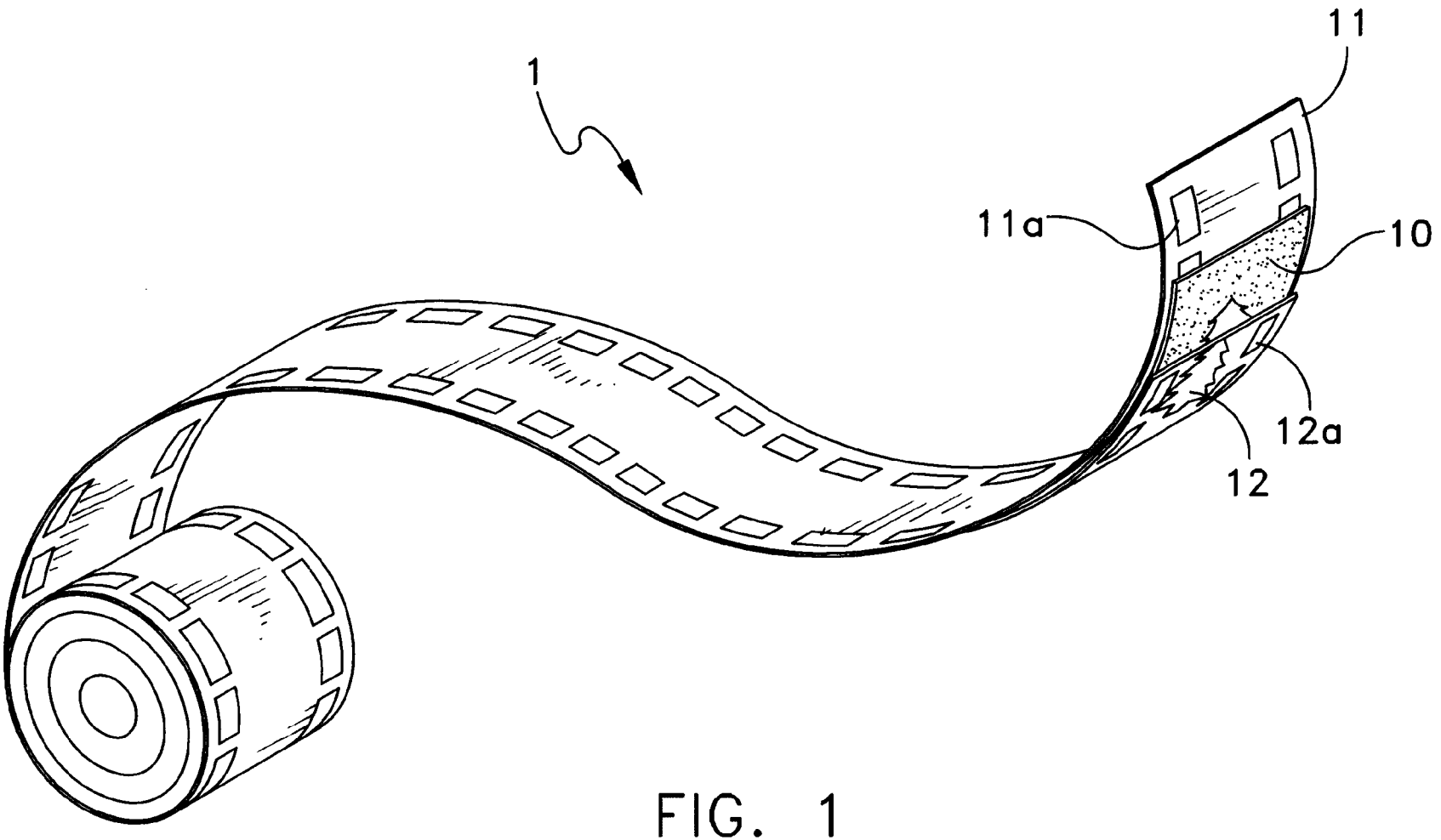
FIG. 1 is partially enlarged perspective of the paper emulsion film sculpture of the present invention.

The film making process of the present invention can be best understood by following an example of its utilization. A photograph or picture is the basic element. In a broader sense any image that can be reproduced on paper is suitable for the present invention. Thus, a wide variety of natural, human-made or specially arranged images can be captured. The photograph is the most utilitarian basic element known to the Applicant since the use of photographs permits the collection of widely-disparate images. An artist may script the photographic images or collect the images from random sources thereby having great flexibility in presentation. The photographs are first reproduced on paper having at least two-ply thickness. The paper reproductions of the photographs can be made using any convenient method of image reproduction including off-set printing and photocopying. The paper reproductions are then framed according to the desires of the artist. Herein lies additional flexibility to the artist utilizing this invention. Clear, perforated editing tape of any gauge and of the type having cold adhesive disposed on one side thereof is applied sticky side to the face of the paper reproduction. The paper reproduction is then secured to the editing tape by rubbing the non-sticky side of the editing tape adjacent a hard surface. Film-size strips are then formed by cutting along the edges of the editing tape to remove extending paper reproduction. The paper reproductions of the photographs may be joined to the editing tape in any arrangement chosen by the artist, but it should be understood that the paper reproductions will generally be attached sequentially along the length of the editing tape.

The tape film strip comprises the editing tape and the paper reproductions attached by means of the editing tape adhesive. The tape film strip is soaked in a first lukewarm water bath, preferably approximately 75–80° temperature, until the editing tape and the rear layer of the respective paper reproductions separate. The tape film strip is then soaked in a clean, second lukewarm water bath and the excess paper reproduction is removed from the paper image layer by gently rubbing the paper reproduction. This step completes the preparation of the paper emulsion 10 (FIG. 1). It is believed that the editing tape adhesive and the image layer of the paper reproduction crystallize to form a paper emulsion. The tape film strip is then allowed to dry under ambient circumstances, preferably a filtered, slow air exchange environment. A paper emulsion sculpture 1, illustrated in FIG. 1, is formed by applying second perforated editing tape 12 with the respective sprockets 11*a*, 12*a* aligned sticky side to the rear of the image layer of the tape film strip thereby sandwiching the paper emulsion 10 between the first editing tape 11 and the second editing tape 12. It should be understood by those skilled in the art that second editing tape 12 may be utilized to prepare a second tape film strip in accordance with the process heretofore described and the respective tape film strips may be joined having the respective paper emulsions merged. Also, it is within the scope of the present invention that physical objects may be sandwiched between the respective editing tapes 11, 12. In either instance the editing tapes 11, 12 may be painted with a film cement or adhesive having characteristics of the editing tape adhesive. The respective paper emulsions 10 or objects may also be dispersed on the respective editing tapes 11, 12 in a manner to leave sufficient tape adhesive to hold them together. The film production process is flexible permitting artists to create a wide variety of uses and film products. The film sculpture film product is also aesthetically pleasing. However, the film sculpture 1 is not suitable for projection of the motion picture. As a final step for the production of a motion picture, film sculpture 1 is printed on film stock which is used to project the paper emulsion 10. The film sculpture 1 is fed for example through an optical printer frame by frame to produce a stock film product which can withstand the wear of handling and operations and protects the images retained.

The motion picture produced by the process of the present invention has a "stereoscopic" effect on the viewer. The images are not only viewed in three dimensions but it appears to suggest that when the film sculpture 1 is printed and projected onto a screen a particular dimension related to the viewer is impacted to give a "touching of the eye" perspective and a "textured" quality to the film sculpture 1 not seen when viewed directly. It is believed that the crystallized paper emulsion 10 effects image retention when projected to create the optical effect of adding a dimension to a recorded image.

The cinematic techniques and film products disclosed in the present invention have been discussed in relation to a novel process including the steps of creating an image, photographing the image and creating a paper emulsion sculpture, and printing the paper emulsion sculpture for preparation of stock film suitable for projection of the paper emulsion sculpture onto a screen. However, the several intermediate products of the process including the paper emulsion 1, the film sculpture 10 and the motion picture are also important new articles of manufacture in accordance with the teachings of the present invention that reduce the work required for complex image composition in film printing.

Therefore, in view of the foregoing I claim:

1. A method of producing a paper emulsion motion picture film product comprising the steps of:

(a) making a photograph;

(b) making a paper reproduction of the photograph;

(c) making a paper emulsion film sculpture from the paper reproduction;

(d) making a stock film print of the film sculpture.

2. A method of producing a paper emulsion motion picture film product comprising the steps of:

(a) making a photograph;

(b) making a paper reproduction of the photograph;

(c) making a paper emulsion film sculpture from the paper reproduction;

(d) making a stock film print of the film sculpture; and (e) projecting the stock film print on a screen.

* * * * *